US006357483B1

(12) United States Patent
Kobayashi

(10) Patent No.: US 6,357,483 B1
(45) Date of Patent: Mar. 19, 2002

(54) FLOW CONTROLLER

(75) Inventor: Hiroaki Kobayashi, Yamanashi (JP)

(73) Assignee: Kabushiki Kaisha Amenity, Yamanashi (JP)

( * ) Notice: Subject to any disclaimer, the term of this patent is extended or adjusted under 35 U.S.C. 154(b) by 0 days.

(21) Appl. No.: 09/634,313

(22) Filed: Aug. 8, 2000

(30) Foreign Application Priority Data

Aug. 10, 1999 (JP) ..... 11-226431

(51) Int. Cl.[7] ..... F15D 1/02
(52) U.S. Cl. ..... 138/40; 138/44
(58) Field of Search ..... 138/44, 41, 40

(56) References Cited

U.S. PATENT DOCUMENTS

| | | | | | |
|---|---|---|---|---|---|
| 1,803,126 | A | * | 4/1931 | Oberhuber | 138/40 |
| 2,190,357 | A | * | 2/1940 | Ginter | 138/44 |
| 2,975,478 | A | * | 3/1961 | Finster | 138/44 |
| 3,145,529 | A | * | 8/1964 | Maloof | 138/44 |
| 4,878,649 | A | * | 11/1989 | Baba et al. | 138/44 |
| 5,315,859 | A | * | 5/1994 | Schommer | 138/44 |
| 5,647,201 | A | * | 7/1997 | Hook et al. | 138/44 |
| 5,893,273 | A | * | 4/1999 | Casiraghi | 138/44 |
| 6,024,129 | A | * | 2/2000 | Schima | 138/44 |

FOREIGN PATENT DOCUMENTS

| | | |
|---|---|---|
| JP | 62-196261 | 5/1986 |
| JP | 3-41283 | 4/1991 |
| JP | 5-100749 | 5/1991 |
| JP | 2660904 | 1/1994 |

* cited by examiner

*Primary Examiner*—James Hook
(74) *Attorney, Agent, or Firm*—Kenneth Watov; Watov & Kipnes, P.C.

(57) ABSTRACT

The present invention provides a water-saving apparatus that is easy to use, and has a higher water conservation effect than a top-like water-saving device. The present invention provides a flow controller in a venturi or jet type configuration, provided in a tubular housing inside of which are formed a dam chamber for damming a stream provided on the upper side, a nozzle orifice formed on a central portion of a bottom wall of the dam chamber, and an outwardly diverging skirt chamber connected below and opening into the nozzle orifice. A stream of water discharged from a feed tap through the flow controller is reduced in flow rate for reducing water consumption by the combination of the dam chamber and the nozzle orifice. However, a feeling of as strong a flow of water as before the installation of the water-saving apparatus is obtained because the combination of the nozzle orifice and the skirt chamber increases the flow velocity while reducing the flow volume per unit time or flow rate.

14 Claims, 5 Drawing Sheets

FIG.3A
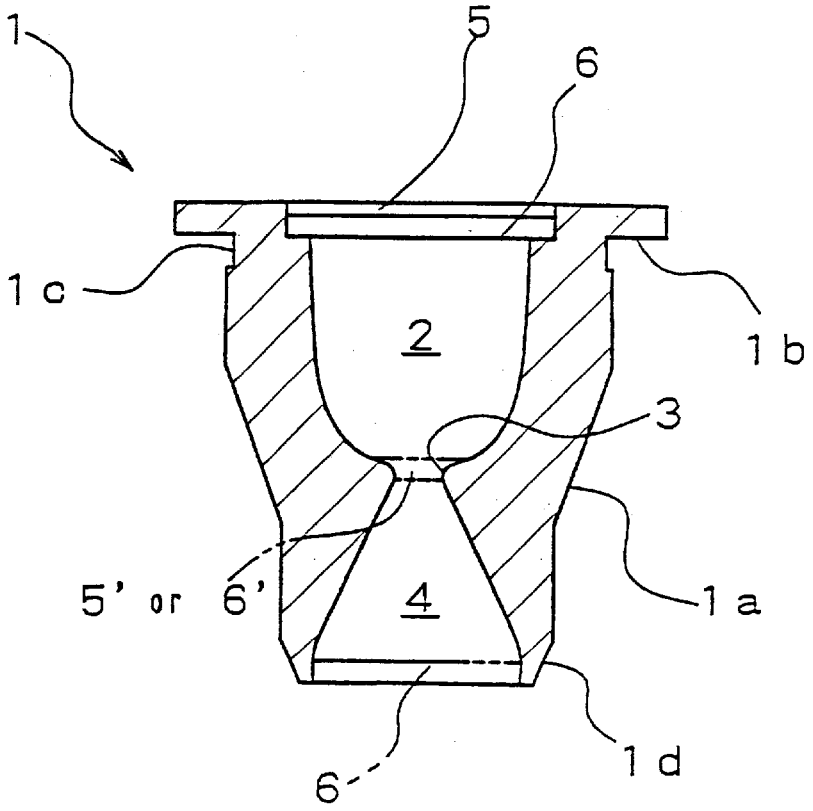
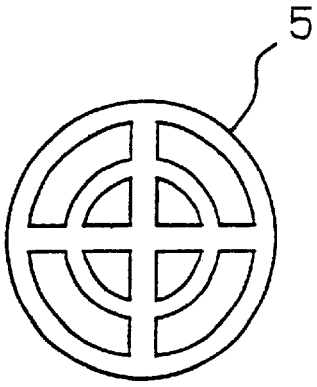
FIG. 3B
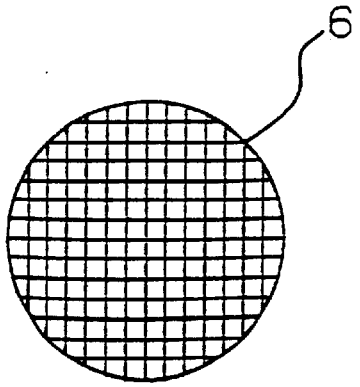
FIG. 3C

FLOW CONTROLLER

FIELD OF THE INVENTION

The present invention relates generally to apparatus for controlling liquid flow rate or volume, and more specifically to such apparatus installed in the channel of a feed tap of a pipe in a water supply system.

BACKGROUND OF THE INVENTION

Economy has been preached recently under consideration for the environment, in which for water conservation, several kinds of measures have been taken. For example, a municipality distributes top-like water-saving devices for feed taps. The water-saving devices reduces the flow when a tap is turned on half way or less. However, when the tap is turned on wide, it cannot control the flow and the flow of water from the feed tap is extremely changed, and thus it does not have good usability.

SUMMARY OF THE INVENTION

The present invention provides a new water conservation apparatus in place of the prior water-saving devices.

According to the present invention, provided is a jet or venturi like flow controller, inside of which are formed a dam chamber damming a stream of water from a feed pipe, a nozzle orifice formed on the wall of the dam chamber and a skirt chamber in a wide-toward-the-end shape connected to and opening into the nozzle orifice.

This flow controller is a type in which the dam chamber dams a water stream from the feed pipe to jet it from the nozzle orifice. A reducer diameter nozzle orifice is preferred to increase the flow speed. Accordingly, the combination of the dam chamber and the nozzle orifice can suppress flow amount to a greater extent. A stream of water jetted from the nozzle orifice is brought together in the jet direction to the deliver direction of the feed tap by the skirt chamber. The skirt chamber has divergent side walls from a nozzle orifice of the darn chamber to the outlet of the skirt chamber. A water stream reduced of the dam chamber and the nozzle. However, the feeling of as strong a flow as before the water-saving apparatus is installed can be obtained because the combination of the nozzle orifice and the skirt chamber add higher speed to the flow. The provided skirt chamber suppresses water-draining noise of the nozzle orifice, resulting in silent flow.

The dam chamber of the flow controller having such function can be in a bowl-like (wine glass-like) shape (having a good damming ability), on the bottom of which the nozzle orifice is formed, or in a cone shape tapering down toward the nozzle orifice (having good machinability). Also the skirt chamber can be in a bowl-glass-like (wine glass-like) shape having the bottom leading to the nozzle orifice or in a wider-to-the-end shape of a cone shape gradually opening wider from the nozzle orifice (suitable material having good machinability is used). A spiral groove can be formed on the wall(s) of one or more of the dam chamber, nozzle orifice and skirt chamber. This adds torsion to the water stream, acting advantageously for the feeling of strong flow.

The flow controller can have a outside shape consisting of a tube that can be fit into a swing discharge pipe provided on the discharge opening of the feed tap, and a jaw in an overhanging form provided on the outer surface of the tube and engaged on the end face of the swing discharge pipe. The jaw, for example, can be sandwiched between a step-wise surface in the discharge opening of the feed tap and the end face of the swing discharge pipe. In this embodiment, the dam chamber, nozzle orifice and skirt chamber are formed in the tube. Further, in this embodiment, it is preferable that a square edge of the top end of the tube on the opening side of the skirt chamber is chamfered or a groove in a recess is provided on the root of the jaw on the outer surface of the tube. The chamfer machined on the top end of the tube forms a clearance for turbulent flow, being able to suppress noise of vibration. Further the groove on the root of the jaw forms a clearance in the case where the swing discharge pipe is deformed, ensuring mounting the jaw on the more or less deformed pipe, helping prevent leakage of water. In addition, it is possible to fit a packing into this groove to further improve the water-blocking ability.

It is also possible to fit both or one of an ionized member made of titanium oxide or the like and an activated member made of far infrared reinforced ceramic or the like into the dam chamber for use. Further, the ionized member and the activated member can be fit also into the nozzle orifice.

BRIEF DESCRIPTION OF THE DRAWINGS

FIG. 3(*a*) is a cross-sectional view of the flow controller of the present invention, into which ionized members and activated members are incorporated.

FIG. 3(*b*) is a plan view of the ionized member.

FIG. 3(*c*) is a plan view of the activated member.

DETAILED DESCRIPTION OF PREFERRED EMBODIMENTS

Figure 4:
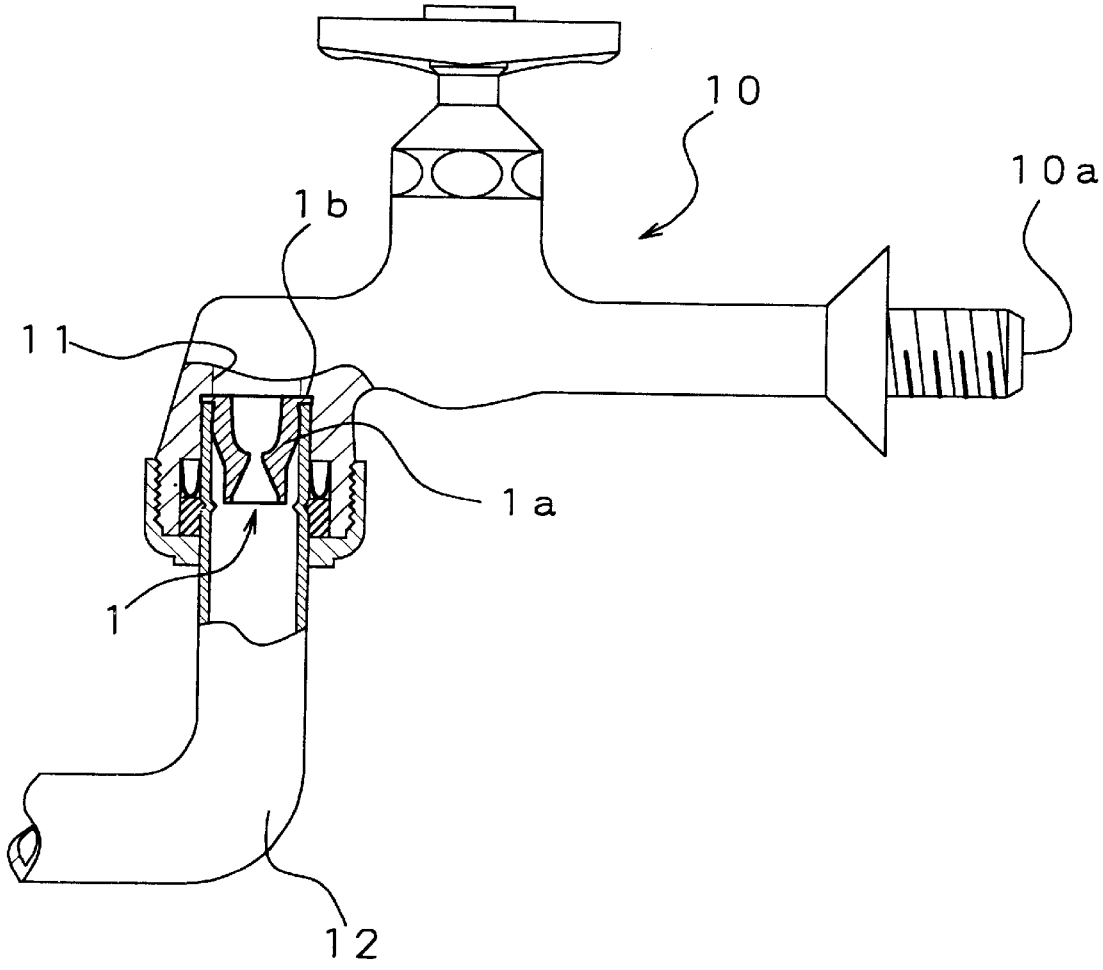
FIG. 4 is a cross-sectional view of an important part showing the flow controller installed in a feed tap.

With reference to FIG. 4, a flow controller 1 has an outside shape consisting of a tube 1*a* configured fit into a swing discharge pipe 12 mounted on a discharge opening 11 of the feed tap 10, and a jaw or radially protruding ledge 1*b* is provided in an overhanging form on the outer surface of the upper side end of the tube 1*a*. Accordingly, when the tube 1*a* is inserted in the swing discharge pipe 12, the jaw 1*b* is engaged on the end face of the swing discharge pipe 12 and is sandwiched between the end face of the swing discharge pipe 12 and a step-wise surface of the discharge opening 11. Thus, the flow controller 1 is installed in the channel of the feed tap 10, exerting its water-saving function. Not limited to this position, the controller 1 can be installed on the side of a root 10*a* of the feed tap 10 or on the top end of the swing discharge pipe 12, that is, can be installed in an appropriate region if it is in the channel of the feed tap in the water feed pipe equipment.

Figure 1:
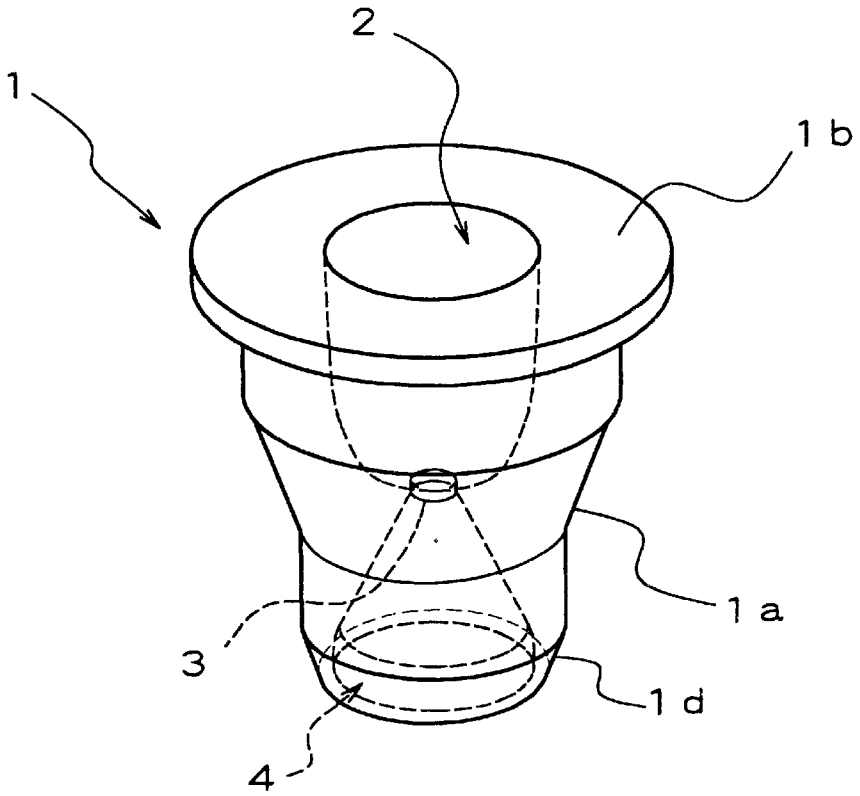
FIG. 1 is a perspective view of a flow controller of the present invention.
Figure 2:
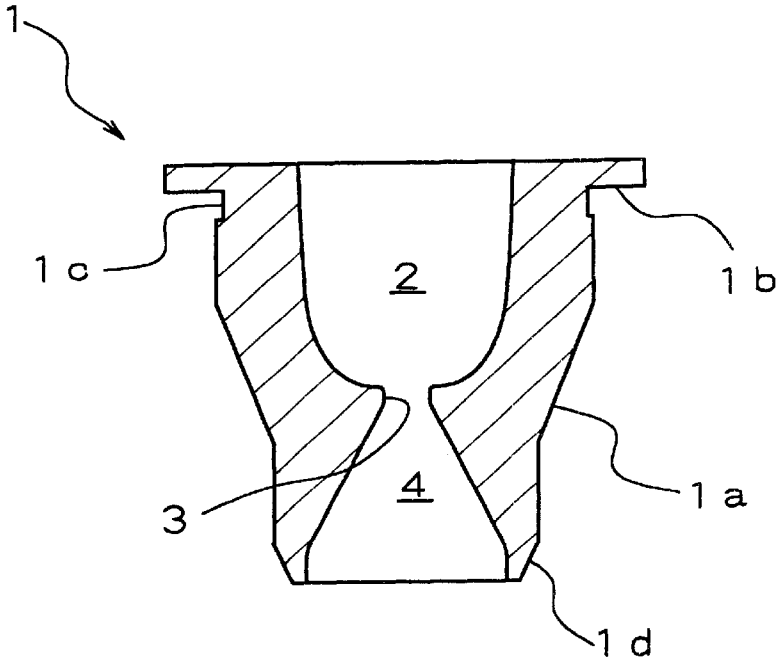
FIG. 2 is a cross-sectional view of the flow controller of the present invention.
Figure 5:
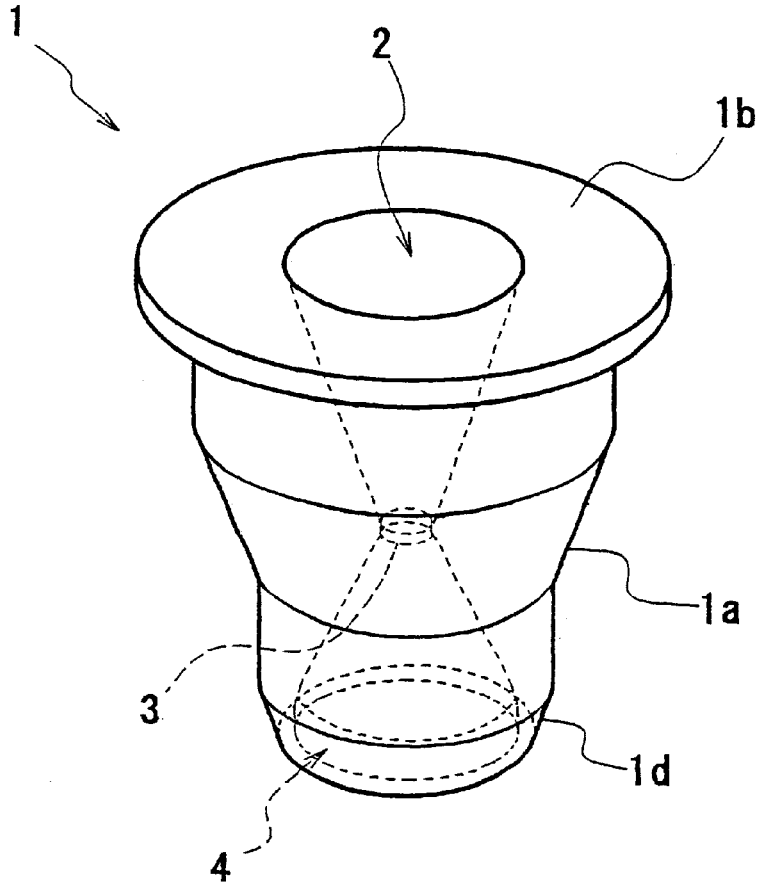
FIG. 5 is a perspective view of a flow controller for another embodiment of the invention.
Figure 6:
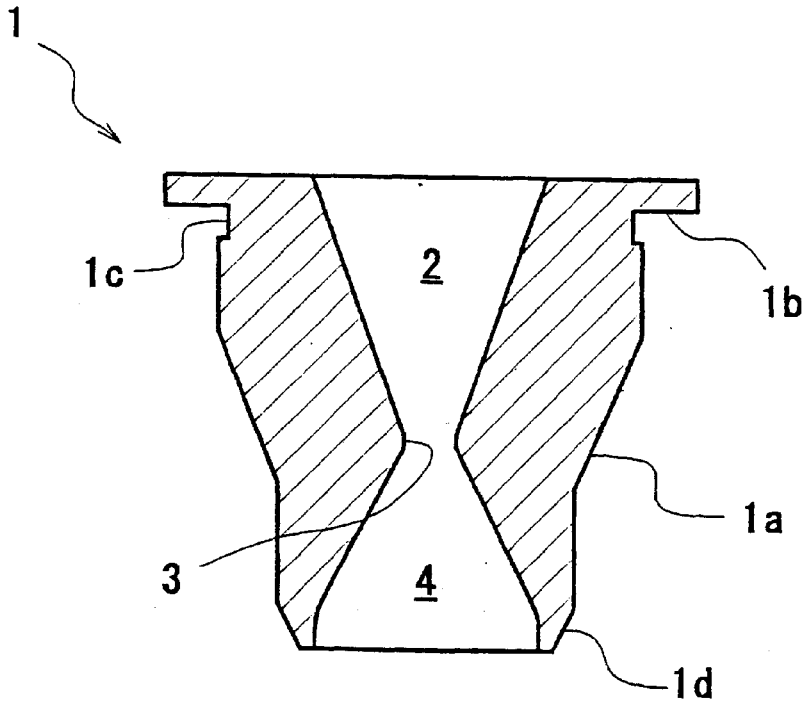
FIG. 6 is a cross-sectional view taken along the longitudinal axis of the flow controller of FIG. 5.
Figure 7:
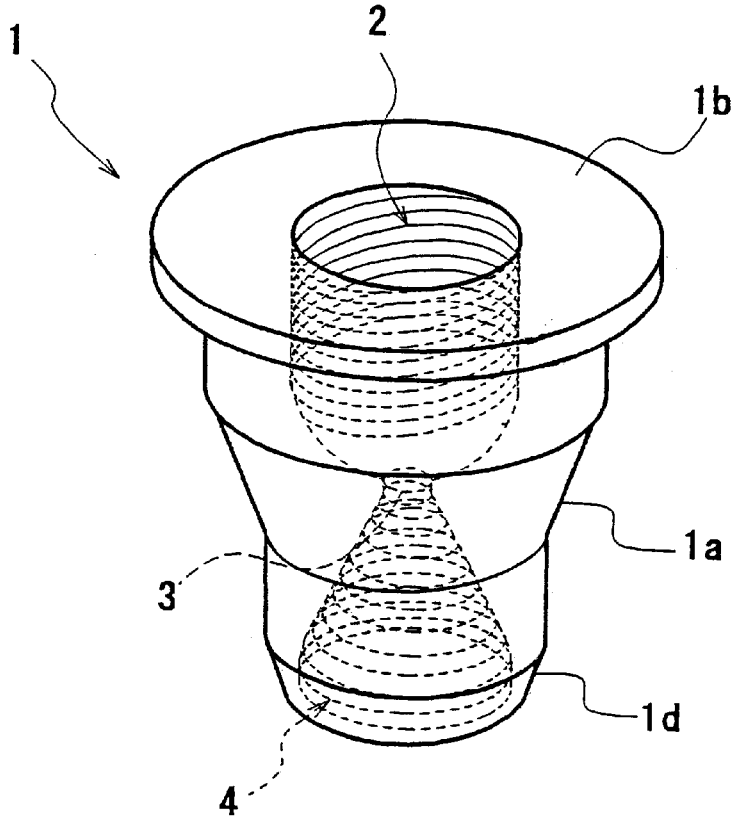
FIG. 7 is a perspective view of the embodiment of FIG. 1 further including spiral grooves formed on interior walls.
Figure 8:
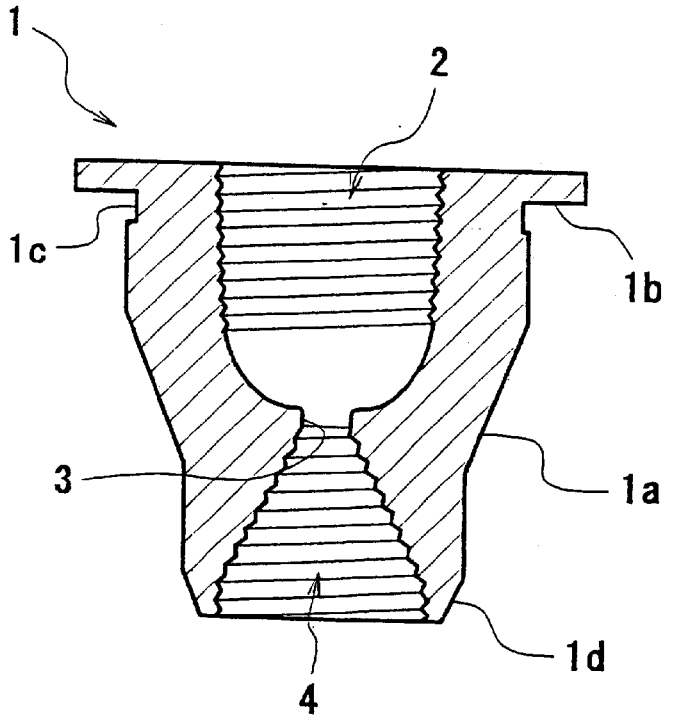
FIG. 8 is a cross-sectional view taken along the longitudinal axis of the embodiment of FIG. 7.

As shown in FIG. 2, the flow controller 1 has a dam chamber 2, a nozzle orifice 3 and a skirt chamber 4 formed continuously inside the tube 1*a*. the dam chamber 2 is formed in a bowl-like shaped opening into the upper stream, which shape receives and dams a stream from the feed pipe. Another such damming shapes include a funnel-like shape and a cone shape like the skirt chamber 4 as shown in FIGS. 5 and 6. Referring to FIGS. 7 and 8, it is possible to form a spiral groove by thread-cutting on the wall of the dam chamber 2 having such a shape. It is preferred to form this spiral groove also in the nozzle orifice 3 and the skirt chamber 4 as also shown in FIGS. 7 and 8.

The nozzle orifice 3 is formed on the bottom of the dam chamber 2. Accordingly, a stream dammed in the wide dam chamber 2 is concentrated to flow out into the thin nozzle orifice 3, resulting in a jet, the speed of which is increased many times the flow speed in the feed pipe. Opening into the nozzle orifice 3, the skirt chamber 4 is continuously formed on the downstream side. The skirt chamber 4 has a cone shape opening wider or continuously diverging as it goes down from the nozzle orifice 3 to the exit or outlet of skirt chamber 4, and serves to rectify the jet injected from the nozzle orifice 3 to the discharge opening of the swing discharge pipe 12. In other words, it exerts the same function as a nozzle opening of a jet engine in the nozzle orifice 3 and the skirt chamber 4. The skirt chamber 4 with such function can be otherwise formed in a funnel-like shape or a bowl-like shape.

Further, in the present embodiment, a groove 1*c* is provided in a recess all around the root or bottom portion of the jaw 1*b* on the outer surface of the tube 1*a*. The groove 1*c* ensures the jaw fits securely on the end of the swing discharge pipe 12 even if the end is deformed more or less in, for example, an oval shape because a clearance for the deformation is formed by groove 1*c*. Furthermore, in the flow controller 1 of the present embodiment, a chamfer id is formed on the top end of the tube 1*a* on the side on which the skirt chamber 4 opens by chamfering the square edge of the end. The chamfer 1*d* influences turbulent flow when water flows and can suppress the noise of vibration as compared in the case where the chamfer 1*d* is not formed.

FIG. 3A shows another embodiment of the flow controller 1. In this embodiment, an ionized member 5 made of titanium oxide and an activated member 6 made of far infrared reinforced ceramic are fit one after the other into the opening end part of the dam chamber 2. Alternatively, they can be fit in several other forms. For example, as shown with dashed lines, the ionized member 5 can be fit into the opening end part of the dam chamber 2 and the activated member 6 can be fit into the opening end part of the skirt chamber 4. With respect to the merchantability and the fit strength, the form shown in FIG. 3A is most suitable. Further, an ionized member 5' or an activated member 6' can be fit into the nozzle orifice 3 by the same method, as required. These members can be provided in single or in combination of two or more of them as shown in the figure.

These ionized members 5, and 5' and activated members 6 and 6', are fit into the installation points after heating and material of flow controller 1, and then cooling the material to cause it to contract tightly around the aforesaid members.

Titanium oxide is suitable for the ionized members 5 and 5'. Titanium has high rigidity and is advantageously resistant to the adhesion of impurities when in a mirror-finished surface, and is lower in gravity than stainless steel and resist oxidation. The member machined by titanium oxide has a larger surface area (a porous structure) and has high ionized effects. It is still more preferred to perform ultraviolet irradiation with respect to the ionized members 5 and 5' made of titanium oxide to make them fully exert their abilities in sterilization the, deodorization and decomposition of toxic-substances.

Far infrared reinforced ceramic is suitable for the activated members 6 and 6'. The activated members have a role of giving simulative stress to water molecules (clusters) flowing through them to alter them, thereby to make the molecules themselves smaller to weaken their surface tension. As a result, of the stream of water the penetration is increased, thereby improved washing of dirty dishes or the like is provided, and also increased absorption into the body of a person drinking the water is provided. In short, the activated members activate water by making water molecule groups of the water smaller to produce "activated water," via activated member made, and thus preferred of hard ceramic in which a fine lattice is easily made.

The flow controller 1 of the present invention can easily be installed in an unmodified typical feed tap 10, for example, the swing discharge pipe 12. Since it has a water saving structure in a jet type comprising the dam chamber 2, nozzle orifice 3 and skirt chamber 4, high water conservation is obtained, without loss of a feeling of strong flow. Accordingly, the flow controller 1 of the present invention can exert an excellent water conservation effect when used in places of business such as restaurants, in homes and so forth.

What is claimed is:

1. A flow controller for installation in the channel of a feed tap, said flow controller comprising:

a dam chamber damming a stream of water from the feed tap, said dam chamber including a top opening for receiving the water, and an interior wall portion forming the dam chamber;

a nozzle orifice formed through a central bottom portion of the wall of the dam chamber;

a skirt chamber below said dam chamber, with said nozzle orifice opening into said skirt chamber, said skirt chamber having interior sidewalls diverging away from said orifice to terminate at an opening for an outlet of said flow controller; and means disposed at the opening side of the skirt chamber for suppressing vibration caused by turbulent water flow through said flow controller.

2. A flow controller according to claim 1, wherein the dam chamber has a bowl-like shape, on the bottom of which the nozzle orifice is formed.

3. A flow controller according to claim 1, wherein the dam chamber has a cone shape tapering down to the nozzle orifice.

4. A flow controller according to claim 1, wherein the skirt chamber has a cone shape.

5. A flow controller according to claim 1, wherein a spiral groove is formed on interior wall(s) of at least one of the dam chamber, nozzle orifice and skirt chamber.

6. A flow controller according to claim 1, wherein an ionized member is fit into the dam chamber in the path of water flow.

7. A flow controller according to claim 1, wherein an activated member is fit into the dam chamber in the path of water flow.

8. A flow controller according to claim 1, wherein an ionized member or an activated member is fit into the nozzle orifice.

9. A flow controller according to claim 1 having an exterior shape consisting of a tubular portion terminating at a circumferential radially protruding lip about an inlet of said dam chamber, said tubular portion surrounding and enclosing the dam chamber, nozzle orifice and skirt chamber.

10. A flow controller according to claim 9, wherein said vibration suppressing means includes a chamfered square edge at a terminating end of the tubular portion on the opening side of the skirt chamber.

11. A flow controller according to claim 9, wherein a groove is provided via a recessed portion in said tubular portion immediately below the circumferential radially protruding lip.

12. A flow controller according to claim 9, wherein an ionized member is fit into the dam chamber in the path of water flow.

13. A flow controller according to claim 9, wherein an activated member is fit into the dam chamber in the path of water flow.

14. A flow controller according to claim 9, wherein an ionized member or an activated member is fit into the nozzle orifice in the path of water flow.

* * * * *